US009510714B2

(12) United States Patent
White

(10) Patent No.: US 9,510,714 B2
(45) Date of Patent: Dec. 6, 2016

(54) REFILL ARTICLE FOR WIPES DISPENSER AND ASSEMBLY OF BOTH

(71) Applicant: THE CLOROX COMPANY, Oakland, CA (US)

(72) Inventor: E. Jason White, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 14/825,441

(22) Filed: Aug. 13, 2015

(65) Prior Publication Data

US 2016/0051099 A1 Feb. 25, 2016

Related U.S. Application Data

(63) Continuation of application No. 13/752,104, filed on Jan. 28, 2013.

(51) Int. Cl.

| | |
|---|---|
| ***B65H 1/00*** | (2006.01) |
| ***A47K 10/42*** | (2006.01) |
| ***B65D 83/08*** | (2006.01) |
| *A47K 10/32* | (2006.01) |

(52) U.S. Cl.

CPC ..... *A47K 10/421* (2013.01); *B65D 83/08* (2013.01); *A47K 2010/3266* (2013.01); *A47K 2010/428* (2013.01); *B65D 2583/005* (2013.01)

(58) Field of Classification Search

CPC ..... A47K 10/42; A47K 2010/3266; A47K 2010/428; B65D 83/08

USPC ..... 221/63, 33, 48, 49, 50, 46, 45, 52, 51; 206/216, 449

See application file for complete search history.

(56) References Cited

U.S. PATENT DOCUMENTS

| | | | | | |
|---|---|---|---|---|---|
| 1,657,942 | A * | 1/1928 | Spaldo | B65D 83/0847 | 206/216 |
| 2,085,649 | A * | 6/1937 | Gluck | B65D 83/0847 | 206/449 |
| 2,195,622 | A * | 4/1940 | Fourness | B65D 83/0894 | 221/51 |
| 2,611,482 | A * | 9/1952 | Nelson | B65D 83/0894 | 221/51 |
| 3,209,941 | A * | 10/1965 | Krake | A47K 10/421 | 206/216 |

(Continued)

OTHER PUBLICATIONS

'Kleenex Perfect Fit' 3 Easy Fit Cylinders Decorator Colors (Blue) ; http://amazon.com ; Apr. 8, 2015; 1 page.

(Continued)

*Primary Examiner* — Rakesh Kumar
(74) *Attorney, Agent, or Firm* — Erin Collins

(57) ABSTRACT

An apparatus for refilling a cylindrical wipes dispenser. The apparatus includes a plurality of rectangular wipes configured in a flat stack and having packaging that contains an opening mechanism. The opening mechanism is operable for opening the apparatus to allow common removal of the plurality of rectangular wipes. The plurality of rectangular wipes are interleaved and folded to form an indentation along a longitudinal axis of the plurality of rectangular wipes. The plurality of rectangular wipes is operable to be folded along the indentation to form a V shape for insertion into a cylindrical dispensing container. The width of the rectangular flat stack wipes is slightly larger than the diameter of the dispensing cylinder.

12 Claims, 9 Drawing Sheets

(56) References Cited

U.S. PATENT DOCUMENTS 3,456,844 A * 7/1969 Planner ..... B65D 83/0847 221/63
3,482,734 A * 12/1969 Augustus ..... B65D 83/0811 206/494
3,612,264 A * 10/1971 Trunick ..... B65D 83/08 206/449
3,700,138 A * 10/1972 Nelson ..... A47K 10/42 206/451
3,881,632 A 5/1975 Early et al.
3,896,966 A * 7/1975 Canno ..... B65D 83/0852 206/494
4,070,489 A * 1/1978 Pahnke ..... B65D 5/545 206/45.2
4,175,673 A * 11/1979 McDonald ..... B65D 83/0805 221/63
4,231,491 A 11/1980 Pierson et al.
4,638,921 A * 1/1987 Sigl ..... A47K 10/421 221/1
4,793,487 A * 12/1988 Bentsen ..... B65D 33/001 206/451
5,305,881 A * 4/1994 Caldwell ..... B65D 83/0088 206/494
5,310,057 A * 5/1994 Caldwell ..... B65D 83/0088 206/494
5,607,754 A 3/1997 Giles et al.
6,030,331 A * 2/2000 Zander ..... A47K 10/421 428/126
6,045,002 A * 4/2000 Wierschke ..... B65H 45/24 206/494
6,213,345 B1 * 4/2001 Plank ..... B65D 83/0805 206/494
6,349,525 B1 2/2002 Veith
6,363,851 B1 * 4/2002 Gerhard ..... B42C 19/06 101/483
6,550,634 B1 * 4/2003 Alegre De Miquel ..... A47K 10/421 221/48
6,585,130 B2 * 7/2003 Turbett ..... A47K 10/424 221/45
6,595,386 B2 * 7/2003 Vogel ..... A47K 10/421 206/494
6,685,050 B2 2/2004 Schmidt et al.
6,901,718 B2 * 6/2005 Osborne ..... B65B 25/145 493/437
6,964,349 B2 * 11/2005 Sears ..... A47K 10/421 206/494
7,028,860 B2 * 4/2006 Behnke ..... A47K 10/422 221/49
7,568,594 B2 * 8/2009 Long ..... A47K 10/421 221/33
7,762,426 B2 * 7/2010 Stevens ..... B65D 43/162 221/154
7,926,680 B2 4/2011 Leitner
8,342,360 B2 * 1/2013 Long ..... B65D 83/0894 206/209
2003/0062376 A1 * 4/2003 Sears ..... A47K 10/421 221/48
2004/0016211 A1 * 1/2004 Osborne ..... B65B 25/145 53/429
2006/0237474 A1 * 10/2006 Long ..... B65D 83/0894 221/33
2007/0215632 A1 * 9/2007 Bendor ..... A47K 10/42 221/63
2008/0135571 A1 6/2008 Long et al.
2009/0190866 A1 * 7/2009 Hughes ..... B65D 75/5844 383/207
2012/0118905 A1 5/2012 Lindbergh
2013/0153597 A1 6/2013 Hill et al.
2014/0174963 A1 6/2014 Bechyne
2014/0209625 A1 * 7/2014 White ..... B65D 83/08 221/63
2014/0231445 A1 8/2014 Possell et al.
2014/0305819 A1 10/2014 Hill et al.
2014/0305957 A1 10/2014 Fulscher et al.
2014/0305958 A1 10/2014 Hill et al.

OTHER PUBLICATIONS

Jan. 8, 2015 Non-Final Office Action for U.S. Appl. No. 13/752,104.
Aug. 28, 2015 Final Office Action for U.S. Appl. No. 13/752,104.

* cited by examiner

REFILL ARTICLE FOR WIPES DISPENSER AND ASSEMBLY OF BOTH

CROSS-REFERENCE TO RELATED APPLICATIONS

The present application is a continuation application of co-pending U.S. patent application Ser. No. 13/752,104, filed Jan. 28, 2013, the disclosure of which is incorporated by reference in its entirety.

FIELD OF THE INVENTION

Embodiments of the present invention are generally related to refilling a cylindrical dispenser with a rectangular wipes refill.

BACKGROUND OF THE INVENTION

The use of disposable wipes has become increasingly popular for cleaning a variety of surfaces. The wipes may be wet, dry, and moistened and include tissues, disinfecting wipes, and dusting wipes for disinfecting, glass cleaning, and automotive cleaning, etc. Wipes are often sold in rigid containers, such as a cylindrical canister. The rigid packaging includes a "doughnut" of circular packaged wipes which dispense from the center of the canister. However, there are currently no economical machines to put a doughnut of wipes into a bag to be used as a refill.

More commonly, wipes may also be sold in flexible rectangular packaging which allows stacked and rectangular wipes to be accessed via a resealable opening, such as an opening having resealable tape. Such flexible packaging is cheaper to manufacture than the rigid container. The flexible packaging can thus act as a dispenser and when the wipes are consumed, the flexible packaging is thrown away. Unfortunately, the resealable opening over time often wears out causing the wipes to prematurely dry out. The dried out wipes are largely useless and thus become wasted. Further, the flexible packages are not as convenient as the rigid packaging for dispensing. For example, the flexible packages may be stored under the sink and may be slip or slide around as a user tries to remove a wipe. Flexible packages also take up more space than a canister. However, stacked, rectangular wipes are very economical to manufacture, more so than a doughnut, circular packaged wipes.

Thus, while such cylindrical rigid containers are advantageous over flexible packages, refills are heretofore not available for cylindrical rigid containers.

SUMMARY OF THE INVENTION

Thus, a need exists for an economical refill of a rigid wipes container. Embodiments of the present invention facilitate refilling of a wipes container (e.g., rigid cylinder) with a flat stack of wipes and thereby allow environmentally friendly reuse of the wipes container. Embodiments of the present invention allow cost savings over the manufacture of a doughnut refill or the cost of an additional wipes container. Embodiments of the present invention further allow the vast resources for manufacturing economical rectangular shaped flat stacks of wipes to be used for making refills for cylindrical wipes containers.

In one embodiment, the present invention is an apparatus for refilling a wipes dispenser. The apparatus includes a plurality of rectangular flat stacked wipes having packaging that contains an opening mechanism (e.g., perforation or tear strip). The opening mechanism is operable for opening the refill pack to allow common removal of the plurality of rectangular wipes. The plurality of rectangular wipes may be interleaved and folded (e.g., in a Z-V pattern) to form an indentation along a longitudinal axis of the plurality of rectangular wipes. The plurality of rectangular wipes is operable to be folded along the indentation to form a V shape, e.g., within the consumer's hand, for insertion into a dispensing container. The width of the refill pack is slightly larger than the diameter of the cylindrical container. The dispensing container is cylindrical, e.g., plastic, and has a height greater than its diameter. The V shape of the plurality of rectangular wipes when inserted into the cylinder facilitates dispensing of the plurality of wipes from a center portion of the dispensing container. The plurality of rectangular wipes may be wetted with a substance selected from the group consisting of a surfactant, water, silicone, and quaternary ammonium salts. In one embodiment, the opening mechanism is not resealable thereby saving cost. The opening mechanism may be proximate to an edge or end of the packaging.

In one embodiment, the present invention is implemented a cylindrical wipe container with refill wipes. The cylindrical container may be plastic and includes a lid assembly operable for dispensing wipes. The lid assembly comprises a dispensing mechanism substantially centered on an edge of the container and the container has a height greater than its diameter. The container further includes a plurality of rectangular shaped flat stacked wipes in a vertical configuration within the container. The plurality of rectangular wipes are interleaved and folded (e.g., in a Z-V fold pattern) to form an indentation along their longitudinal axis. The plurality of rectangular wipes is folded along the indentation to form a V shape within the container. Each of the plurality of rectangular wipes is dispensed from a center portion of a void formed in the center of the V shape through the dispensing mechanism. In one embodiment, the plurality of rectangular wipes comprises a starter panel also located at a center portion of the V shape. The container may further include packaging laterally surrounding the plurality of rectangular wipes which facilitates insertion of wipes into the container. In one embodiment, the width of the plurality of rectangular wipes is slightly greater than the diameter of the container. In one exemplary embodiment, a ratio of the width in inches of the plurality of rectangular wipes to the diameter in inches of the container is 4.5/3.7.

In another embodiment, the present invention includes a rigid cylindrical wipe container operable for dispensing a first plurality of wipes through a first dispensing mechanism. The height of the container is greater than its diameter. The present invention further includes a package comprising a refill plurality of wipes that are rectangular in shape and flat stacked. The refill plurality of wipes are interleaved and folded (e.g., in a Z-V pattern) to form an indentation along a longitudinal axis of the plurality of wipes. The plurality of wipes is operable to be folded along the indentation to form a V shape and operable to be inserted into the cylindrical container. In one embodiment, a ratio of the width in inches of the plurality of wipes to the diameter in inches of the container is greater than one (e.g., 4.5/3.7). The refill wipes may be packaged and the package allows insertion of the refill plurality of wipes into the container without the consumer contacting the refill plurality of wipes. The packaging may comprise an opening mechanism for facilitating removal the refill plurality of wipes from the package. The opening mechanism is operable for removing a portion of the package to expose the refill plurality of wipes. The apparatus may further include a refill dispensing mechanism operable to replace the first dispensing mechanism in the case that multiple wipe refill packages may be degrade the operation of the first disposing mechanism.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Embodiments of the Invention

Figure 1:
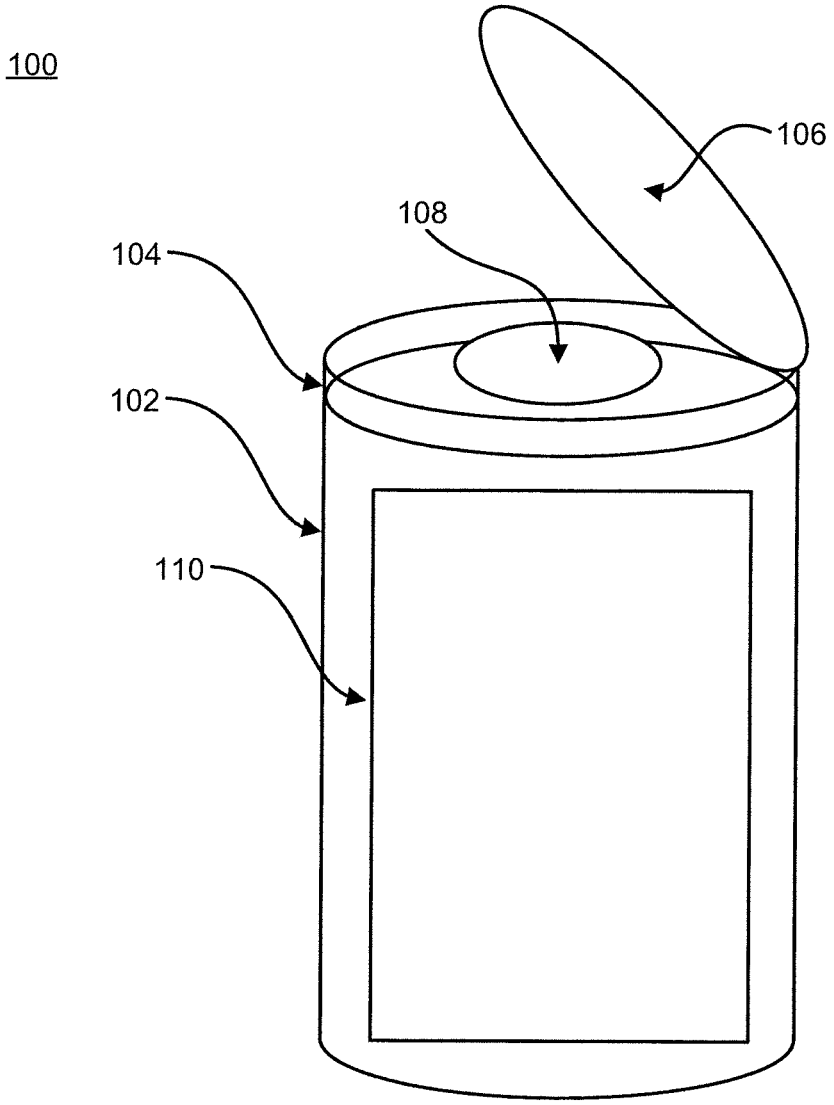
FIG. 1 shows a diagram of an exemplary cylindrical wipe dispenser and wipes in accordance with one embodiment of the present invention.

FIG. 1 shows a diagram of an exemplary cylindrical dispenser assembly and wipes in accordance with one embodiment of the present invention. Exemplary dispenser assembly 100 includes cylindrical container 102 and circular lid assembly 104. Exemplary dispenser assembly 100 is operable to allow dispensing of wipes wrapped or packaged in a doughnut configuration or a rectangular stack of wipes orientated in a vertical configuration, as described further herein. Wipes 110 may be operable for use in a variety of applications including, for instance, automotive applications, disinfecting, and glass cleaning, etc.

Lid assembly 104 may be plastic and may include dispensing mechanism 108 and top 106. Lid assembly 104 is removable from container 102 to allow insertion of wipes from a refill package. Lid assembly 104 includes a seal to retain moisture in container 102. Top 106 further preserves moisture by sealing dispensing mechanism 108. Exemplary dispenser 100 is operable to allow wipes to be dispensed through dispensing mechanism 108, e.g., via slits molded or cut therein.

Container 102 may be a cylinder of plastic fabrication with a height greater than the width. In one exemplary embodiment, container 102 is 3.7 inches in diameter. In another embodiment, container 102 may be square or rectangular in shape and may have rounded edges. It is appreciated that container 102 may be a variety of shapes and its diameter may vary depending on the maximum wipe count it dispenses. Container 102 may be recyclable.

In one embodiment, exemplary dispenser assembly 100 is operable to house and allow dispensing of wipes 110 in a vertical configuration through slits 108. Dispensing mechanism 108 allows a first wipe of a set of wipes (e.g., of a doughnut or stack configuration) to be pulled out of the center of container 102 and facilitates retention of subsequent wipes for easy access. In one embodiment, dispensing mechanism 108 is substantially centered in lid assembly 104. Dispensing mechanism 108 may have teeth or fingers disposed along with the openings to facilitate retention of a subsequent wipe after a wipe has been removed.

In one exemplary embodiment, refill wipes 110 are of a rectangular and stacked configuration and disposed in a V shape within container 102. Wipes 110 are dispensed from the center of the V shape up through dispensing mechanism 108. In one embodiment, portions of dispensing mechanism 108 are hinged to lid assembly 104 and drop down into container 102 to allow a finger to drop inside for the retrieval of wipes 110. The folded "V" shape of wipes 110 allows for portions of dispensing mechanism 108 to drop into the space or void, allowing the consumer to start the dispensing of a new package of wipes 110. Furthermore, the first wipe, in the "void" of the V, may have a starter panel fold included to further ease starting the first wipe.

Figure 2:
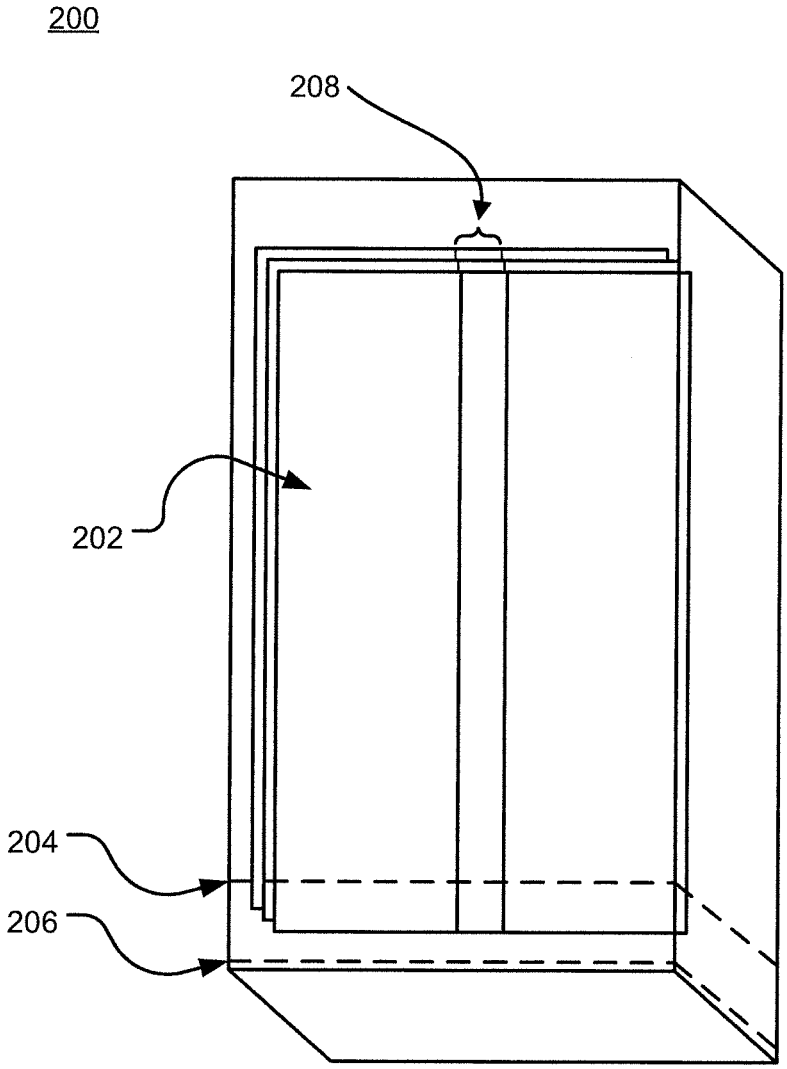
FIG. 2 shows a diagram of an exemplary rectangular stacked wipe refill package in accordance with one embodiment of the present invention.

FIG. 2 shows a diagram of an exemplary rectangular stacked refill package in accordance with one embodiment of the present invention. Exemplary refill package 200 includes stacked wipes 202 and has opening mechanisms 204 or 206. Exemplary refill package 200 may include flexible packaging. Refill package 200 is operable for refilling a wipes dispenser (e.g., dispensing assembly 100). In one embodiment, wipes 202 are rectangular in shape disposed within rectangular shaped flexible packaging.

Opening mechanisms 204 and 206 facilitate opening of refill package to remove wipes 202 (e.g., by tearing or cutting along opening mechanisms 204 and 206). Opening mechanisms 204 and 206 may be any of a variety of well known packaging opening mechanisms including perforations (e.g., laser made perforations) or tear strips. Opening mechanism 204 allows opening of refill package 200 such that prefolded wipes 202 are slightly exposed. Opening mechanism 206 allows opening of refill package 200 such that wipes 202 are substantially not exposed. It is appreciated refill package 200 may have either opening mechanism 204 or opening mechanism 206. Opening mechanisms 204 and 206 may be located at or proximate to any edge or end of refill package 200. Opening mechanism 204 and 206 allow common removal of wipes 202 such that wipes 202 can be removed together as a unit from refill package 200.

Refill package 200 facilitates insertion of wipes 202 into a cylindrical dispensing container (e.g., dispensing assembly 100) without the consumer's hand having to come into contact with wipes 202. Wipes 202 may be inserted into a cylindrical dispensing container with or without the use of refill package 200 (e.g., FIG. 3). For example, refill package 200 may be opened via opening mechanism 204 and 206 and inserted into a cylindrical dispensing container. Alternatively, wipes 202 may be inserted into a cylindrical dispensing container by dropping wipes 202 from refill packaging 200 into the dispensing container. The number of wipes in refill packaging 200 may correlate to the diameter or other dimension of the container to be refilled. For example, as the container diameter is decreased the maximum number of wipes of the refill package will be decreased. Rectangular refill packaging 200 may further include instructions on how to insert the wipes into a cylindrical container including how to open refill packaging 200, bend or fold the wipes, and orient and insert the wipes into a cylindrical container.

In one embodiment, wipes 202 have an indentation or notch 208 which is formed by the fold pattern of wipes 202. Indentation 208 allows rectangular shaped wipes 202 to be inserted into a cylindrical dispensing container in a folder shape or V shape (e.g., folded in the longitudinal direction). In one exemplary embodiment, the width of wipes 202 is slightly greater than the diameter of the cylindrical dispensing container, therefore the V shaped fold facilitates the insertion of the plurality of wipes into the container.

It is appreciated that refill package 200 may not have an opening for the dispensing of wipes individually nor a resealable mechanism (e.g., resealable tape).

Figure 3:
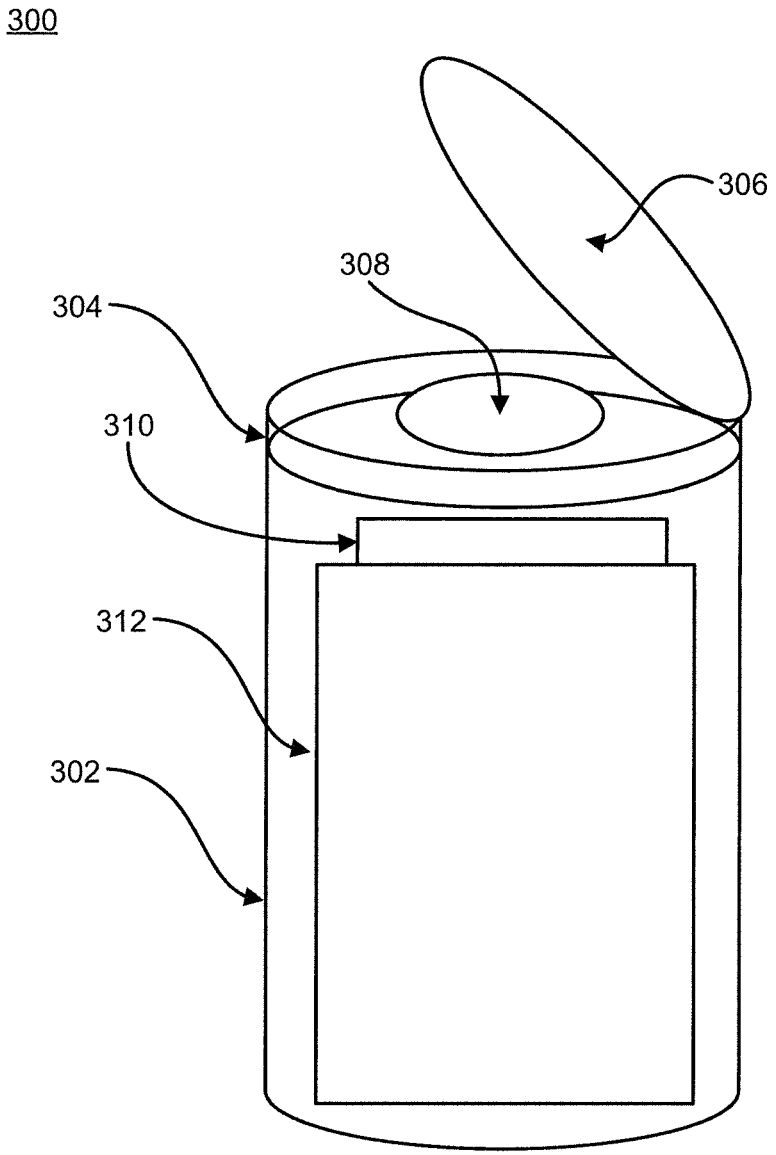
FIG. 3 shows a diagram of an exemplary cylindrical wipe dispenser with wipes and refill packaging in accordance with one embodiment of the present invention.

FIG. 3 shows a diagram of an exemplary cylindrical dispenser configuration with wipes and rectangular stacked refill packaging in accordance with one embodiment of the present invention. Exemplary dispenser configuration 300 includes cylindrical container 302, lid assembly 304, stacked and folded wipes 310, and rectangular refill package 312. Exemplary dispenser configuration 300 shows dispenser with an opened refill package 312 (e.g., top or bottom portion removed) and inserted to container 302. Lid assembly 304 includes top 306 and dispensing mechanism 308. Lid assembly 304 may be removed before wipes 310 (and/or refill package 312) are inserted into container 302.

The insertion of refill package 312 with wipes 310 into container 302 allows insertion of wipes 310 without a consumer having to come into contact with wipes 310. As such, embodiments of the present invention allow a consumer to refill a cylindrical dispensing container without having to get their hands wet or exposed to the wipes. It is appreciated that wipes 310 may be removed from refill package 312 and then inserted into dispensing container 302.

In one embodiment, rectangular refill package 312 is sized large enough such that wipes 310 can be folder prior to insertion into dispensing container 302. Refill package 312 may be sized in width such that it is somewhat larger than the diameter or opening of container 302.

Figure 4:
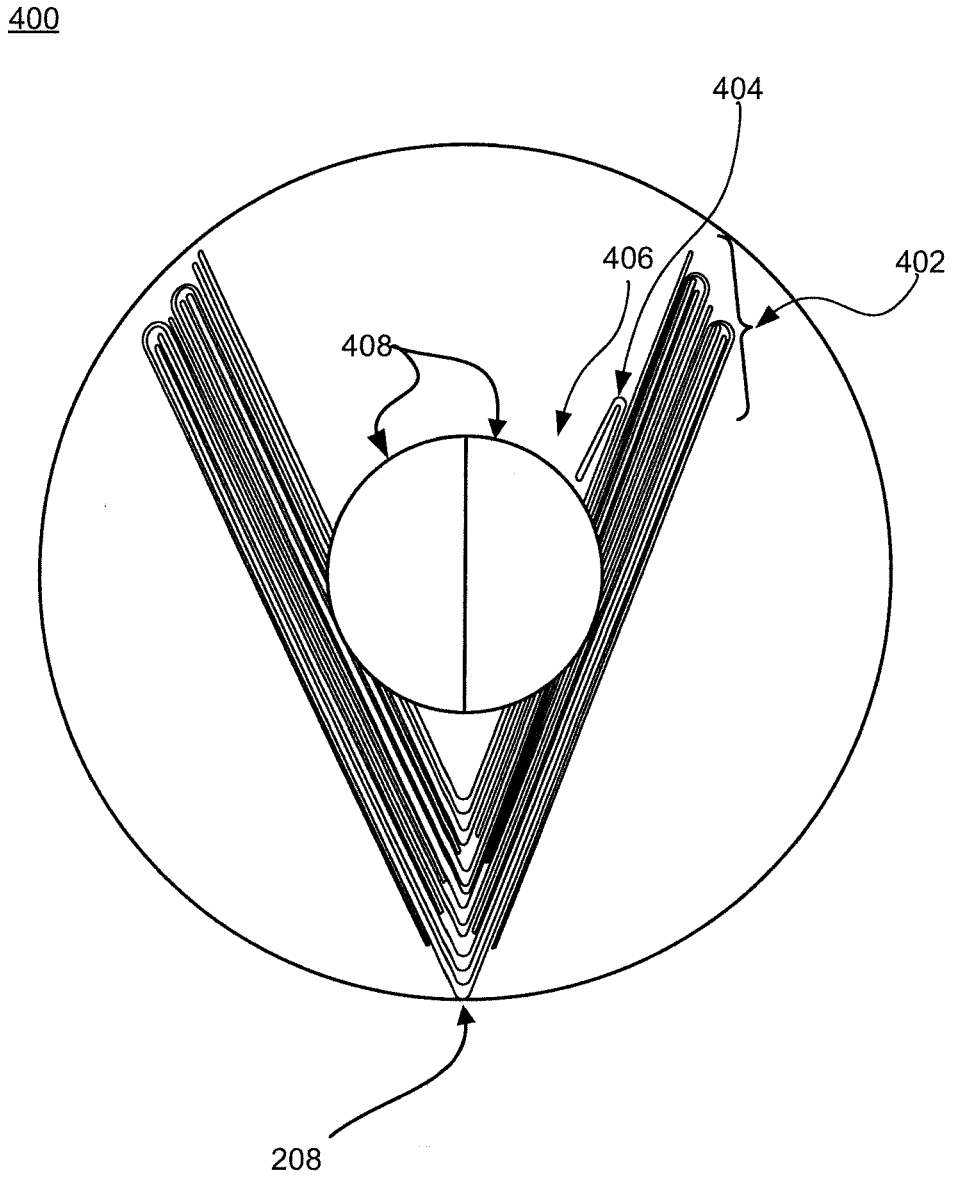
FIG. 4 shows a diagram of a top view of an exemplary cylindrical dispenser with wipes in accordance with one embodiment of the present invention.

FIG. 4 shows a diagram of an exemplary top view of a cylindrical dispenser with rectangular stacked wipes inserted therein in accordance with one embodiment of the present invention. Exemplary dispenser 400 has dispensing mechanism 406 and wipes 402. Exemplary dispenser 400 may have wipes 402 inserted from a rectangular refill package (e.g., refill package 200) or at manufacture. In one embodiment, dispensing mechanism 406 has portions 408 which are hinged and drop down into dispenser 400. Portions 408 facilitate retrieval of a first wipe of wipes 402 as well as retention of individual wipes for future use. Portions 408 may further facilitate retrieval of the first wipe without the need to remove a lid assembly by allowing a finger to reach inside the dispenser. Portions 408 may also help with moisture retention.

Wipes 402 may include starter panel 404 which facilitates the pulling of a first wipe of wipes 402 through dispensing mechanism 406. In one embodiment, starter panel 404 is a portion of a wipe that has been shortened or folded toward the center to be easily pulled away from wipes 402. The starter panel may be located in the center portion of the V shape. It is noted wipes 402 are oriented in a vertical configuration along the longitudinal axis of the cylinder and folded in a V shape. The movement of portions 408 into the free space of the V shape of wipes 402 facilitates easy grasping of the starter panel 404.

Each wipe of wipes 402 is thereafter dispensed from the center or inside of the V shape formed by the fold of wipes 402. It is appreciated that the folded shape of wipes 402 allows easy dispensing of the wipes from the center as opposed to dispensing from against the wall of container 400. Starter panel 404 is now close to the center of exemplary dispenser 400 thereby easing the path to and through the closure. The void space created in the center portion of the V shape allows the wipes to unfold during the dispensing procedure, allowing single wipe dispensing, and greatly reducing the propensity for wipes to jam in the dispensing mechanism of the lid.

Wipes 402 are folded in a longitudinal direction which also adds stiffness or rigidity to the stack of wipes 402. The rigidity facilitates wipes 402 maintaining a vertical orientation and being dispensed without the stack collapsing (or bending down). Increased stiffness helps the stack stay upright in the exemplary dispenser 400 during use and thereby improves performance of the last few wipes in the stack. It is appreciated that since consumers usually use a single wipe or a few wipes at a time, this rigidity is particularly useful when the number of wipes remaining in the can is low.

Figure 5:
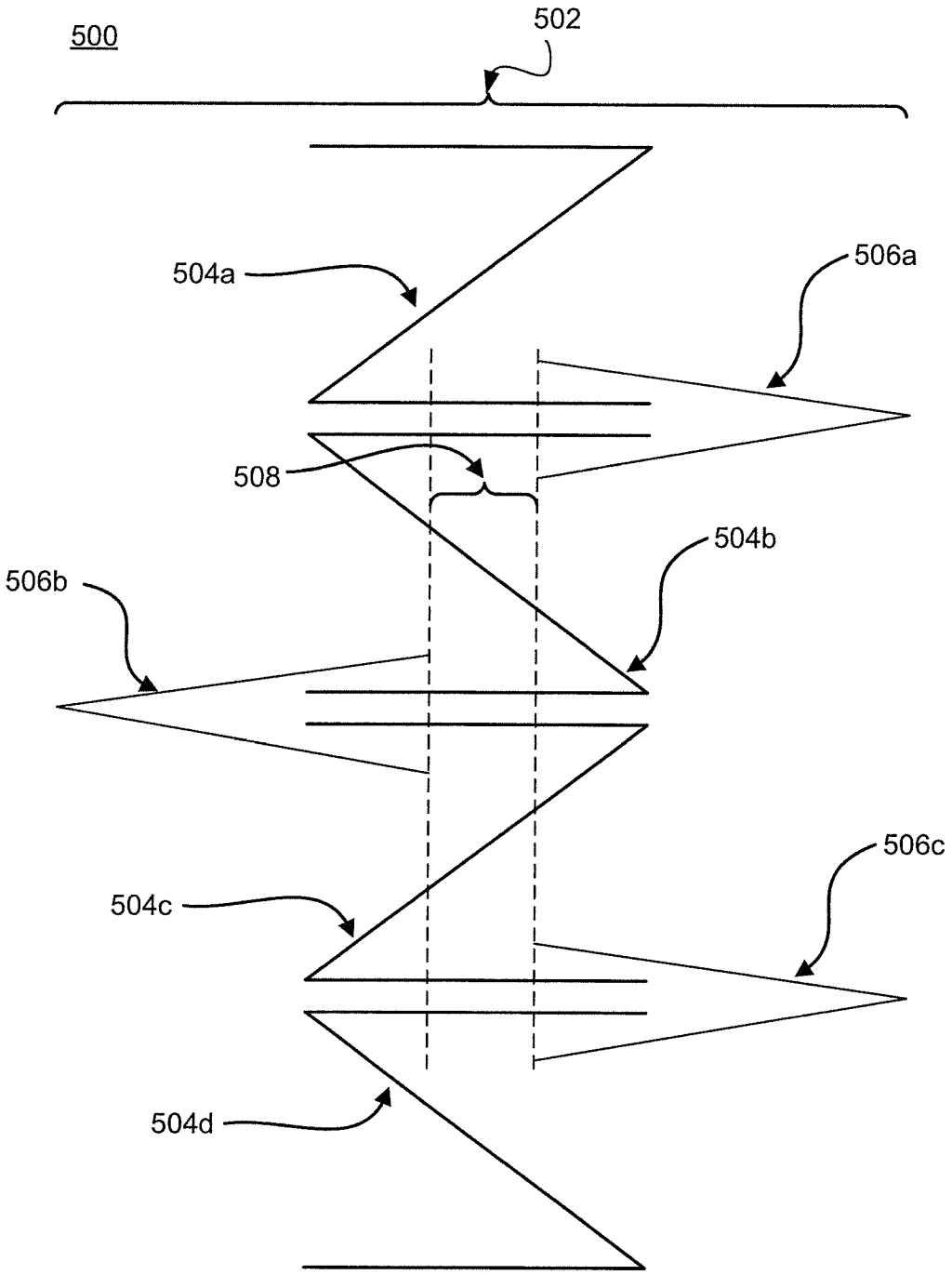
FIG. 5 shows a diagram of an exemplary interleaving and fold pattern of stacked wipes in accordance with one embodiment of the present invention.

FIG. 5 shows a diagram of an exemplary interleaving and fold pattern of wipes in accordance with one embodiment of the present invention. Exemplary fold pattern 500 allows wipes in a vertical configuration to be pulled from a dispensing container and dispensed in a continuous manner. The friction between the wipes allows a wipe to be dispensed while pulling the next wipe into position for dispensing at a dispensing mechanism. It is appreciated that embodiments of the present invention may support other and different types of interleaving and fold patterns.

Exemplary fold pattern 500 includes Z folded wipes 504*a-d* and V folded wipes 506*a-c*. As shown, V folded wipes 506*a-c* are interleaved with Z folded wipes 504*a-d*. Fold pattern 500 has spacing 508 between the edges of V folded wipes 506*a-c* such that when the wipes are stacked and interleaved together, there is a indentation (e.g., indentation 208) in the stack of wipes (e.g., in the longitudinal direction) which facilitates folding the wipes into a V shape for insertion into a dispensing container.

In one exemplary embodiment, fold pattern 500 has a width 502 of 4.5 inches and each unfolded wipe is seven inches by eight inches. The 4.5 inch wide stack may be used with a 3.7 inch diameter cylindrical container for example. A stack of 3.5 or 3.25 inches may be used for a 3 inch diameter cylindrical container. Therefore, width 502 may be larger than the width of the cylindrical container. The ratio of the width of the folded wipes in inches to the diameter of the container in inches may be greater than one (e.g., 4.5/3.7).

In one embodiment, each wipe may have a smooth side and a patterned side. Fold pattern 500 may be such that patterned sides of the wipes are interleaved against smooth sides and smooth sides are interleaved against both patterned sides and smooth sides.

Figure 6:
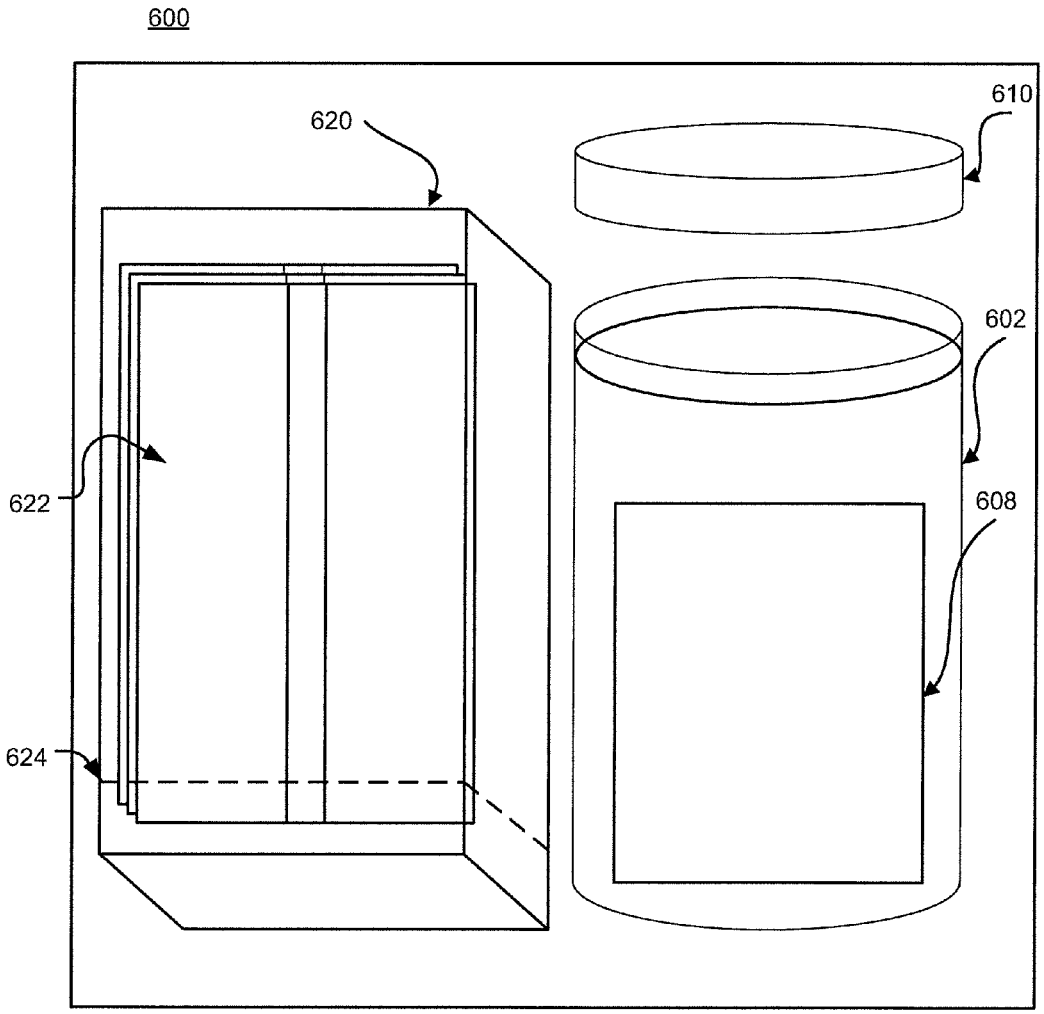
FIG. 6 shows a diagram of an exemplary packaging of a refill package and plastic cylindrical wipe dispenser assembly in accordance with one embodiment of the present invention.

FIG. 6 shows a diagram of an exemplary consumer item including a refill package and dispenser assembly in accordance with one embodiment of the present invention. Exemplary packaging 600 includes rectangular stacked refill package 620, cylindrical dispensing container 602, and optionally lid assembly 610. Dispensing container 602 may also include wipes 608 which may have a doughnut configuration or a vertical configuration (e.g., V shape fold of wipes 622 in refill package 620). Lid assembly 610 may be an additional lid to allow a consumer to replace the original lid assembly of dispensing container 602. For example, a consumer may replace the lid assembly of dispensing container 602 if the dispensing mechanism of dispensing container 602 wears out or breaks after repeated refills.

Exemplary packaging 600 may come in a variety of configurations including three rectangular stacked refill packages 620 with one filled cylindrical dispensing container 602, three refill packages 620 with one filled dispensing container 602 and a lid assembly 610, two filled dispensing containers 602 with one or more refill packages 602, etc., or other various combinations. A pallet may be composed of half dispensing containers 602 and half refill packages 620.

Figure 7:
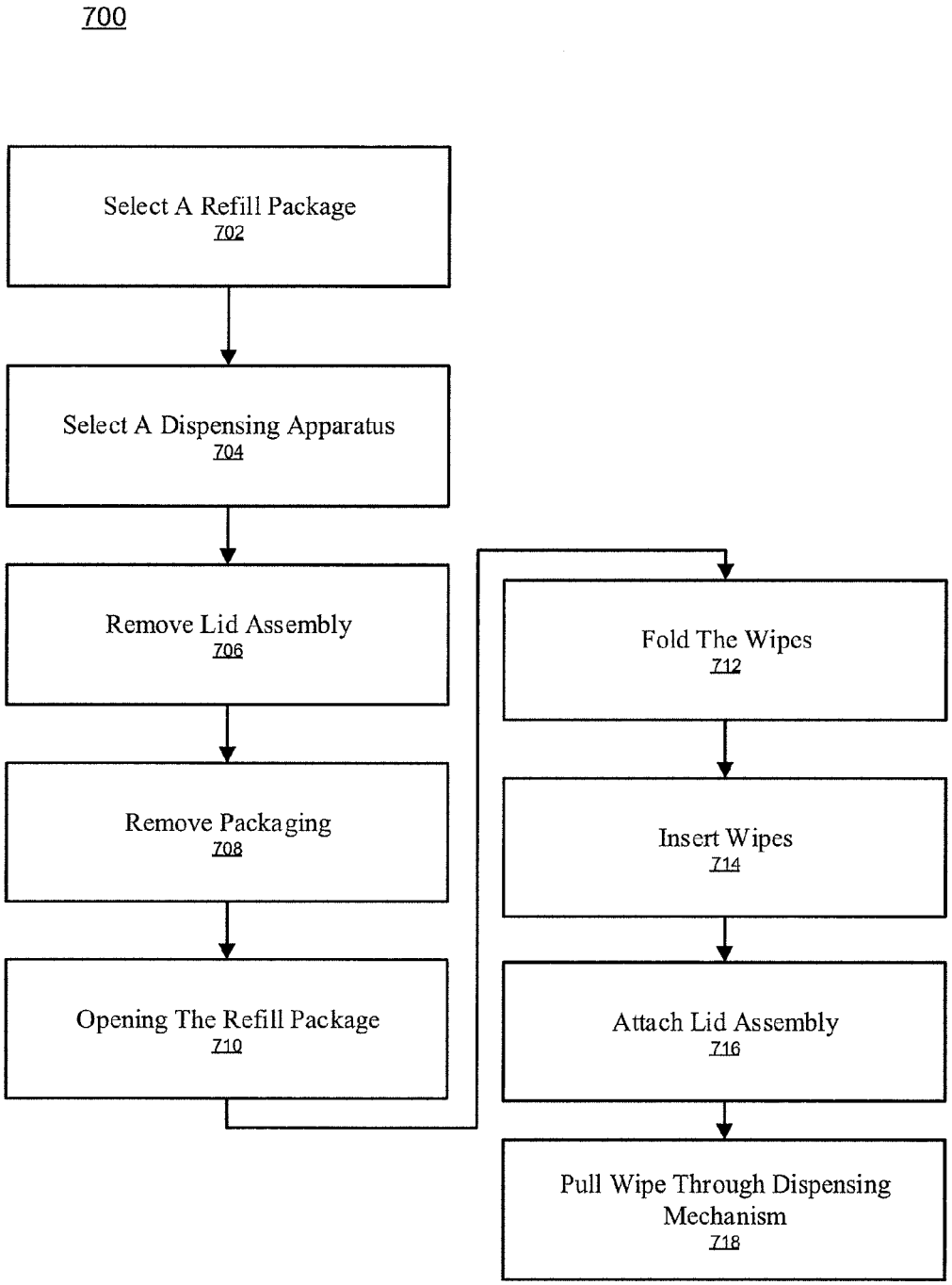
FIG. 7 shows a flowchart of an exemplary process for loading a cylindrical dispenser with wipes from a rectangular stacked refill package in accordance with one embodiment of the present invention.

FIG. 7 shows a flowchart of an exemplary process 700 that a consumer can follow for loading a cylindrical dispenser with wipes from a rectangular refill package in accordance with one embodiment of the present invention. Process 700 may also be used to load wipes into a cylindrical wipe dispenser in a vertical configuration during manufacture.

At block 702, a rectangular stacked refill package is selected. In one embodiment, refill packaging includes rectangular wipes in a flat stack which has a slight longitudinal indentation, as described herein.

At block 704, a dispensing apparatus is selected. In one embodiment, dispensing apparatus is a plastic cylindrical dispenser assembly including a lid assembly and a dispensing mechanism. The diameter of the cylinder is slightly smaller than the width of the refill stack.

At block 706, a lid assembly is removed. The lid assembly may be removed by a consumer.

At block 708, packaging is removed from the dispensing apparatus if present. The packaging may be used refill packaging that was inserted into the dispensing apparatus during a prior refill or during manufacture.

At block 710, the new refill package is opened. The refill package may be opened via an opening mechanism which allows removal of a portion of the refill packaging to expose the rectangular stacked wipes.

At block 712, rectangular flat stacked wipes are folded for insertion into the dispensing apparatus. As described herein, the wipes are folded into a V shape along a longitudinal axis (e.g., along the indentation in the wipes).

At block 714, wipes are inserted into the cylindrical dispensing apparatus with the opening of the packaging oriented at the tope of the dispenser. By holding the packaging, the wipes may be inserted by a consumer without having to come into contact with the wipes.

At block 716, a lid assembly is attached. The lid assembly may be the lid assembly previously removed or a new lid assembly (e.g., lid assembly 610).

At block 718, a starter wipe is pulled through a dispensing mechanism. A user or consumer may pull a wipe including a starter panel through the dispensing mechanism by placing a finger into the center void of the V shaped wipe refill and grabbing a wipe.

Figure 8:
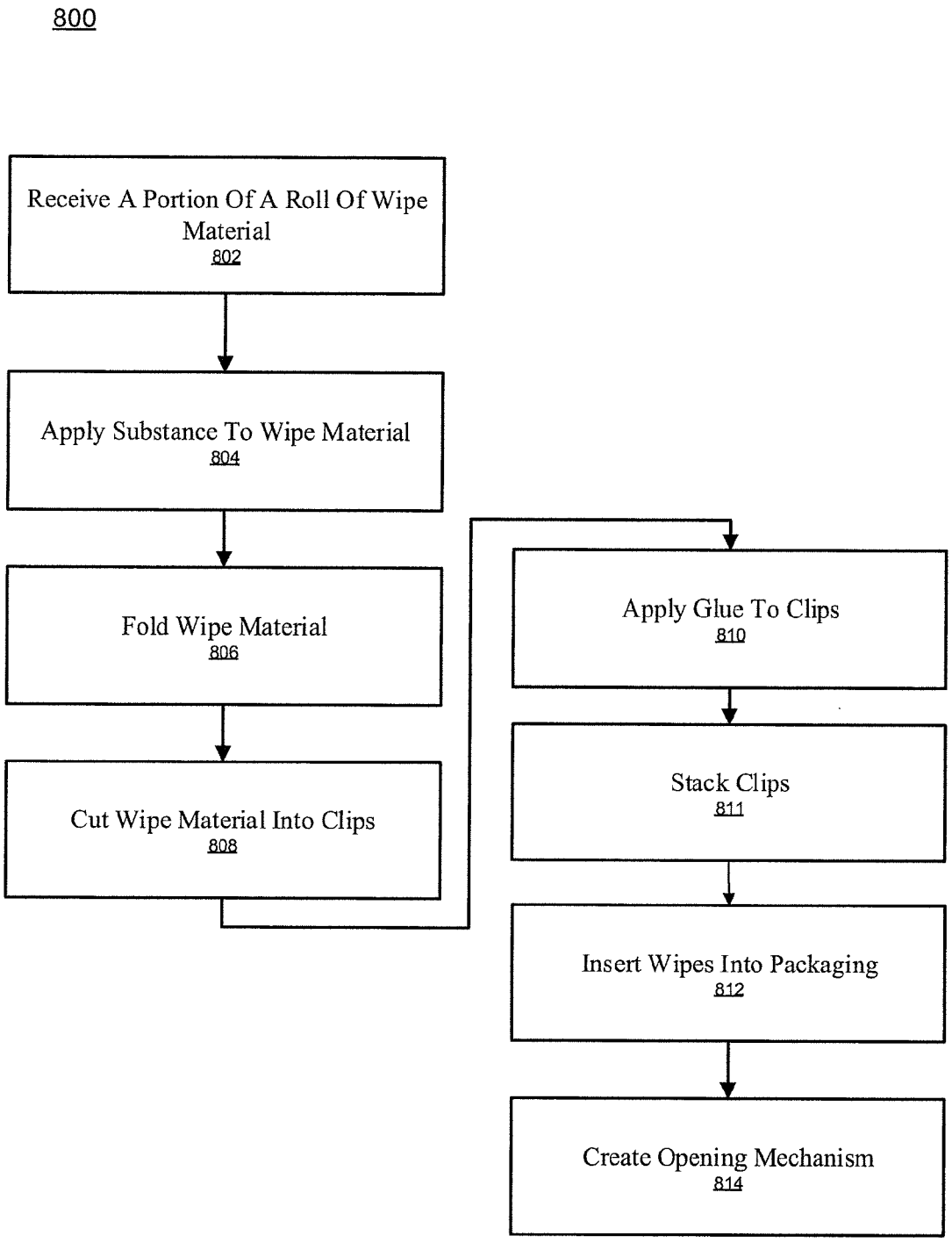
FIG. 8 shows a flowchart of an exemplary process for manufacturing a wipes refill package in accordance with one embodiment of the present invention.

FIG. 8 shows a flowchart of an exemplary process for manufacturing a rectangular wipes refill package. Process 800 may be used to make a rectangular shaped flat stack refill of wipes for a rigid dispenser assembly, as described herein At block 802, a portion of a roll of wipe material is received. In one embodiment, 15 rolls of wipe material are fed into a machine for interleaving and folding the wipes.

At block 804, a substance is applied to the wipe material. Wipes may be wetted as they are folded by being run over a dosing or wicking bar. In one embodiment, wipe material is wetted with a surfactant lotion, water, and quaternary ammonium salts. Automotive wipes may be wetted with a silicone lotion. It is appreciated that a variety of other chemistries can be applied to the wipe material.

At block 806, wipe material is folded. As described herein, the wipe material may be interleaved and folded into a Z-V pattern with a longitudinal indentation.

At block 808, the wipe material is cut into clips. Each clip is a set of wipes which may then be combined with other clips to form a set of wipes for a refill package or dispenser apparatus. The clips may cascade over each other upon the folding of the wipes into a V shape which helps with insertion.

At block 810, glue is applied to the clips. Glue beads may be used to couple clips together. The amount of glue and placement is selected to prevent fallback of a wipe into the container (e.g., too little glue) and tearing of the wipe (e.g., too much glue).

At block 811, the clips are stacked together creating a brick of wipes. For example, for a refill package with 75 wipes, 5 clips of 15 wipes may be glued and stacked together.

At block 812, wipes are inserted into rectangular packaging material (e.g., refill packaging 200). The packaging may then be sealed.

At block 814, opening mechanisms may be created on the packaging. As described herein, the opening mechanism may be a perforation or a tear strip. Since the package is meant for refilling a dispenser, the opening need not be resealable, thereby saving cost. Alternately, the opening mechanism may be incorporated into the pre-printed refill packaging material, eliminating the need for block 814.

Figure 9:
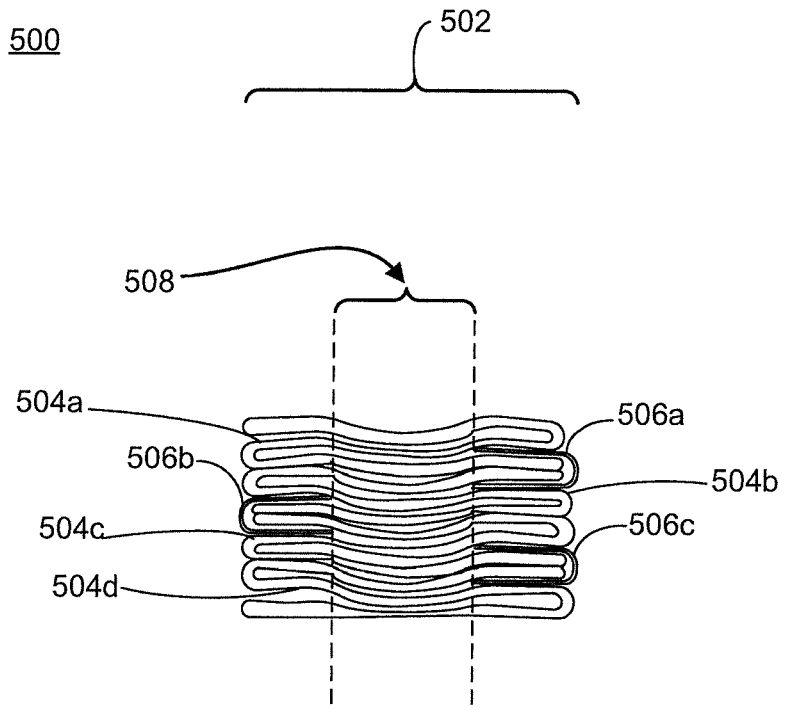
FIG. 9 shows a diagram of an exemplary interleaving and fold pattern of stacked wipes in accordance with one embodiment of the present invention.

FIG. 9 shows a diagram of an exemplary interleaving and fold pattern of stacked wipes in accordance with one embodiment of the present invention. FIG. 9 depicts exemplary fold pattern 500 includes Z folded wipes 504*a-d* and V folded wipes 506*a-c* in a stacked configuration.

Embodiments of the present invention facilitate refilling of a wipes container (e.g., rigid cylinder) with a rectangular flat stack of wipes and thereby reuse the wipes container. Embodiments of the present invention are economical over the manufacture of doughnut wipes and the cost of new wipes containers. Embodiments of the present invention further allow the vast resources for manufacturing flat stacks of wipes to be used for making refills for cylindrical wipes containers.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A wipes dispenser comprising:

a container;

a dispensing mechanism having an opening and wherein said dispensing mechanism is coupled to said container; and a plurality of flat stacked rectangular wipes interleaved and folded into a Z-V pattern having Z folded wipes and V folded wipes, wherein edges of the Z folded wipes are aligned with one another, wherein edges of the V folded wipes overlap the edges of the Z folded wipes, wherein the edges of each V folded wipe are spaced apart from the edges of a subsequent V folded wipe in said plurality of flat stacked rectangular wipes to form an indentation along a longitudinal axis thereof, and wherein said plurality of flat stacked rectangular wipes are positioned inside the container and are oriented in a vertical configuration, such that the longitudinal axis of the wipes extends from the top to the bottom of the container without any bending, and said wipes are folded into a V shape along said indentation along the longitudinal axis thereof.

2. The dispenser as described in claim 1 wherein said container has a height that is greater than its diameter.

3. The dispenser as described in claim 1 wherein said stack of rectangular wipes comprises a starter panel disposed at a center portion of said V shape.

4. The dispenser as described in claim 1 wherein said container is substantially cylindrical in shape.

5. The dispenser as described in claim 4 wherein a ratio of said width in inches of said plurality of unfolded, stacked rectangular wipes to said diameter in inches of said cylindrical container is approximately 4.5/3.7.

6. The dispenser as described in claim 1 wherein said container has a lid assembly comprising a seal to retain moisture in said container.

7. A wipes dispenser comprising:

a container with a height that is greater than its diameter;

a lid assembly with a dispensing mechanism that is substantially centered in said lid assembly; and a plurality of flat stacked rectangular wipes interleaved and folded into a Z-V pattern having Z folded wipes and V folded wipes, wherein edges of the Z folded wipes are aligned with one another, wherein edges of the V folded wipes overlap the edges of the Z folded wipes, wherein the edges of each V folded wipe are spaced apart from the edges of a subsequent V folded wipe in said plurality of flat stacked rectangular wipes to form an indentation along a longitudinal axis thereof, and wherein said plurality of flat stacked rectangular wipes are positioned inside the container and are oriented in a vertical configuration, such that the longitudinal axis of the wipes extends from the top to the bottom of the container without any bending, and said wipes are folded into a V shape along said indentation along the longitudinal axis thereof.

8. The dispenser as described in claim 7 wherein a ratio of said width in inches of said plurality of unfolded, stacked rectangular wipes to said diameter in inches of said container is about 4.5/3.7.

9. The dispenser as described in claim 7 wherein said lid assembly comprises a seal to retain moisture in said container.

10. The dispenser as described in claim 9 wherein said plurality of rectangular wipes are wetted.

11. The dispenser as described in claim 7 wherein said container is a cylindrical.

12. A wipes dispenser comprising:

a cylindrical container;

a lid assembly with a dispensing mechanism that is substantially centered in said lid assembly; and a plurality of flat stacked rectangular wipes interleaved and folded into a Z-V pattern having Z folded wipes and V folded wipes, wherein edges of the Z folded wipes are aligned with one another, wherein edges of the V folded wipes overlap the edges of the Z folded wipes, wherein the edges of each V folded wipe are spaced apart from the edges of a subsequent V folded wipe in said plurality of flat stacked rectangular wipes to form an indentation along a longitudinal axis thereof, and wherein said plurality of flat stacked rectangular wipes are positioned inside the container and are oriented in a vertical configuration, such that the longitudinal axis of the wipes extends from the top to the bottom of the container without any bending, and said wipes are folded into a V shape along said indentation along the longitudinal axis thereof.

* * * * *